US010637182B1

(12) United States Patent
Martin et al.

(10) Patent No.: US 10,637,182 B1
(45) Date of Patent: Apr. 28, 2020

(54) CIRCULAR PLUG CONNECTOR

(71) Applicant: TE CONNECTIVITY CORPORATION, Berwyn, PA (US)

(72) Inventors: Andrew Monroe Martin, Mechanicsburg, PA (US); Kevin Michael Thackston, York, PA (US); Samantha Kay Heisey, Palmyra, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/417,759

(22) Filed: May 21, 2019

(51) Int. Cl.

| | |
|---|---|
| ***H01R 4/38*** | (2006.01) |
| ***H01R 13/533*** | (2006.01) |
| ***H01R 24/86*** | (2011.01) |
| ***H01R 13/502*** | (2006.01) |
| *H01R 13/622* | (2006.01) |
| *H01R 107/00* | (2006.01) |
| *H01R 13/6581* | (2011.01) |

(52) U.S. Cl.
CPC ..... *H01R 13/533* (2013.01); *H01R 13/502* (2013.01); *H01R 24/86* (2013.01); *H01R 13/622* (2013.01); *H01R 13/6581* (2013.01); *H01R 2107/00* (2013.01)

(58) Field of Classification Search
CPC .. H01R 13/533; H01R 13/562; H01R 13/502; H01R 13/5025; H01R 13/622; H01R 13/6581; H01R 24/86; H01R 2107/00
USPC ..... 439/382–385, 660
See application file for complete search history.

(56) References Cited

U.S. PATENT DOCUMENTS

| | | | | |
|---|---|---|---|---|
| 4,901,987 | A | 2/1990 | Greenhill et al. | |
| 6,758,465 | B1 | 7/2004 | Greenhill et al. | |
| 9,429,179 | B2 * | 8/2016 | Tran | F16B 21/10 |
| 2019/0148875 | A1 * | 5/2019 | Ostermann | H01R 13/5219 |
| 2019/0181584 | A1 * | 6/2019 | Yamashita | H02G 3/086 |

* cited by examiner

*Primary Examiner* — Khiem M Nguyen

(57) ABSTRACT

A circular plug connector includes an outer coupling ring, a plug shell and a self-supporting compression element between the outer coupling ring and the plug shell. The plug shell houses plug contacts. The plug shell includes a mid-body having a rear facing support surface. The self-supporting compression element surrounds the plug shell and includes a spring element engaging the rear facing support surface. The self-supporting compression element includes a retaining shim support integral with the spring element as a unitary, monolithic body that is received in the retaining element to fix the self-supporting compression element relative to the outer coupling ring. The spring element is compressible relative to the retaining shim support to allow the plug shell to move axially within the cavity of the outer coupling ring.

20 Claims, 2 Drawing Sheets

CIRCULAR PLUG CONNECTOR

BACKGROUND OF THE INVENTION

The subject matter herein relates generally to electrical connectors.

Some known electrical connectors provide an interface for high speed data transmission cables. The cables typically include shielded parallel pair cables or various types of coax cables terminated contacts arranged within the electrical connector. Some known electrical connectors are manufactured according to military specifications. For example, in electronic enclosures, panel connectors are used to interconnect the signals originating inside an enclosure and to other avionic boxes. MIL-C-38999 connectors are popular connectors used widely in the military and aerospace avionics applications. However, the electrical connectors are used in harsh environments and subject to vibration. Some known electrical connectors utilize a spring element contained within the connector housing to maintain mating compliance. However, the electrical connectors use multiple retaining components to hold the spring element in place within the electrical connector, such as a retaining rasher and a snap ring to hold the retaining washer and the spring element in the connector housing. The multiple components add additional parts and assembly complexity for the electrical connector, leading to additional cost for manufacturing and assembling the electrical connector.

BRIEF DESCRIPTION OF THE INVENTION

In one embodiment, a circular plug connector is provided. The circular plug connector includes an outer coupling ring that has a cavity extending between a front and a rear. The outer coupling ring includes a retaining element proximate to the rear. The outer coupling ring includes a mating element proximate to the front that is configured to be coupled to a mating connector. A plug shell extends between a front and a rear. The plug shell houses one or more plug contacts that are configured to be coupled to the mating connector. The plug shell has a front body at the front configured to be coupled to the mating connector. The plug shell has a rear body at the rear. The plug shell includes a mid-body between the front body and the rear body that has a rear facing support surface. The circular plug connector includes a self-supporting compression element surrounding the rear body. The self-supporting compression element extends between a front and a rear. The self-supporting compression element includes a spring element at the front. The self-supporting compression element includes a retaining shim support at the rear. The retaining shim support is integral with the spring element as a unitary, monolithic body. The retaining shim support is received in the retaining element to fix the self-supporting compression element relative to the outer coupling ring. The spring element engages the rear facing support surface to support the plug shell within the cavity of the outer coupling ring. The spring element is compressible relative to the retaining shim support to allow the plug shell to move axially within the cavity of the outer coupling ring.

In another embodiment, a circular plug connector is provided. The circular plug connector includes an outer coupling ring that has a cavity extending between a front and a rear. The outer coupling ring includes a retaining element proximate to the rear. The outer coupling ring includes a mating element proximate to the front that is configured to be coupled to a mating connector. A plug shell extends between a front and a rear. The plug shell houses one or more plug contacts that are configured to be coupled to the mating connector. The plug shell has a front body at the front configured to be coupled to the mating connector. The plug shell has a rear body at the rear. The plug shell includes a mid-body between the front body and the rear body having a rear facing support surface. The circular plug connector includes a self-supporting compression element surrounding the rear body. The self-supporting compression element is received in the retaining element to fix the self-supporting compression element relative to the outer coupling ring. The self-supporting compression element engages the rear facing support surface to support the plug shell within the cavity of the outer coupling ring. The self-supporting compression element is compressible to allow the plug shell to move axially within the cavity of the outer coupling ring.

In a further embodiment, a connector system is provided. The connector system includes a circular plug connector and a circular mating connector coupled together. The circular mating connector includes an outer housing that has a mating end and an inner housing that is received in the outer housing. The inner housing holds mating contacts. The circular plug connector includes an outer coupling ring that has a cavity extending between a front and a rear. The outer coupling ring includes a retaining element proximate to the rear. The outer coupling ring includes a mating element proximate to the front coupled to the mating end of the circular mating connector. The circular plug connector includes a plug shell extending between a front and a rear. The plug shell houses plug contacts coupled to corresponding mating contacts of the mating connector. The plug shell has a front body at the front coupled to the outer housing of the mating connector. The plug shell has a rear body at the rear. The plug shell includes a mid-body between the front body and the rear body having a rear facing support surface. The circular plug connector includes a self-supporting compression element surrounding the rear body. The self-supporting compression element extends between a front and a rear. The self-supporting compression element includes a spring element at the front. The self-supporting compression element includes a retaining shim support at the rear. The retaining shim support is integral with the spring element as a unitary, monolithic body. The retaining shim support is received in the retaining element to fix the self-supporting compression element relative to the outer coupling ring. The spring element engages the rear facing support surface to support the plug shell within the cavity of the outer coupling ring. The spring element is compressible relative to the retaining shim support to allow the plug shell to move axially within the cavity of the outer coupling ring.

DETAILED DESCRIPTION OF THE INVENTION

Figure 1:
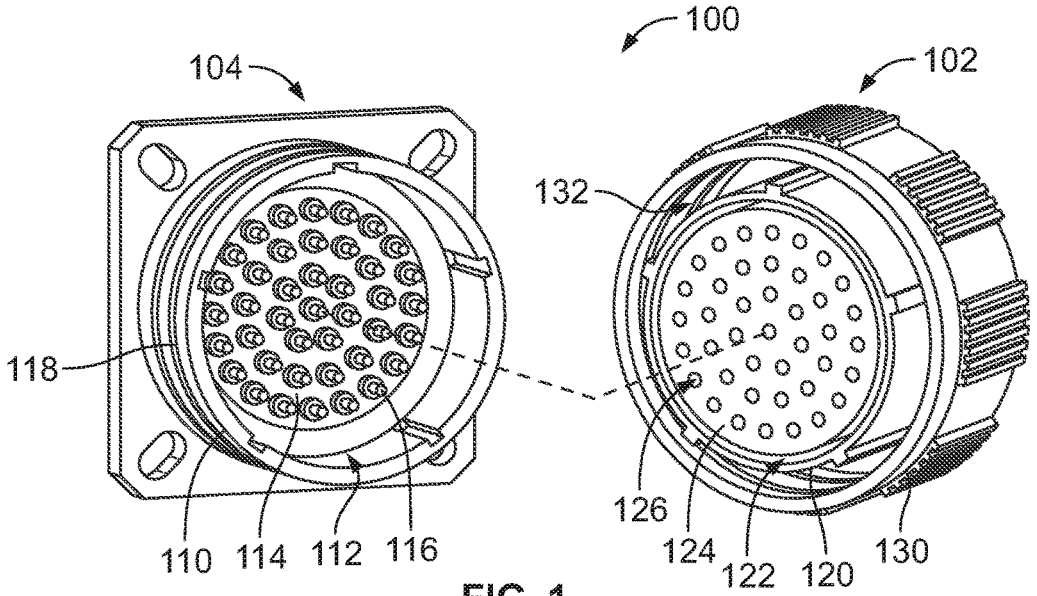
FIG. 1 illustrates a connector system having a circular plug connector formed in accordance with an exemplary embodiment.

FIG. 1 illustrates a connector system 100 formed in accordance with an exemplary embodiment. The connector system 100 includes a circular plug connector 102 and a circular mating connector 104 configured to be mated together. The connector system 100 is used to connect two data communication cables (not shown) together or to connect a data communication cable to a circuit board (not shown). For example, the data communication cable(s) may be Ethernet cables transmitting data across a computer network. The data communication cable(s) may be fiber optic cables. The circular plug connector 102 is configured to be terminated to the end of the corresponding data communication cable or mounted to a circuit board. The circular mating connector 104 is configured to be terminated to the end of the corresponding data communication cable or mounted to a circuit board. The circular plug connector 102 and circular mating connector 104 are mated together to create an electrical connection therebetween. Data is transmitted across the interface between the circular plug connector 102 and the circular mating connector 104.

In an exemplary embodiment, the circular plug connector 102 and circular mating connector 104 are designed for use in a rugged environment, such as an environment that is subject to extreme shock, vibration and the like. In one exemplary application, the connector system 100 is configured for use in military applications that require data capability in harsh environments. Other applications include industrial applications, aerospace applications, marine applications, and the like. The subject matter herein may have application in other moderate environments, such as in building network systems. In the illustrated environment, the circular plug connector 102 and the circular mating connector 104 constitute high performance cylindrical connectors, designed in accordance with the MIL-DTL-38999 standard. Optionally, the circular mating connector 104 may be panel mounted.

The circular mating connector 104 includes an outer housing 110 having a cavity 112 therein. In the illustrated embodiment, the outer housing 110 includes a mounting flange 113 for mounting the circular mating connector 104 to a panel or other structure. An inner housing 114 is received in the cavity 112. The inner housing 114 includes mating contacts 116 configured to be mated with the plug contacts 126. Optionally, an outer surface of the outer housing 110 may include threads 118 for threaded mating with the circular plug connector 102.

The circular plug connector 102 includes a plug shell 120 having a cavity 122 therein. A plug insert 124 is received in the plug shell 120. In an exemplary embodiment, the plug shell 120 and the plug insert 124 are generally cylindrical. The plug insert 124 includes plug contacts 126. In an exemplary embodiment, the plug shell 120 is manufactured from a metal material and may provide electrical shielding for the plug contacts 126 and the plug insert 124. In the illustrated embodiment, the mating contacts 116 are pin contacts and the plug contacts 126 are socket contacts configured to receive the pin contacts to create an electrical connection therebetween. In other various embodiments, the mating contacts 116 are socket contacts and the plug contacts 126 are pin contacts. Other types of contacts may be used in alternative embodiments, such as fiber-optic contacts.

In an exemplary embodiment, the circular plug connector 102 includes an outer coupling ring 130 surrounding the plug shell 120. The outer coupling ring 130 includes a mating element 132 used to secure the circular plug connector 102 to the circular mating connector 104. The outer coupler ring 130 is generally cylindrical. The outer coupler ring 130 may be manufactured from metal material or plastic material. In various embodiments, the outer coupling ring 130 may be a threaded coupler. For example, the mating element 132 of the outer coupler ring 130 may include internal threads for threadably coupling the circular plug connector 102 to the circular mating connector 104. In other various embodiments, the mating element 132 may be another type of mating element, such as a bayonet coupler, a breech lock coupler or another type of coupler.

When the circular plug connector 102 is coupled to the circular mating connector 104, the plug contacts 126 are mated with the mating contacts 116 to make a data communication connection therebetween. Data is transmitted across the interface between the connectors 102, 104. When the outer housing 110 and the plug shell 120 are coupled together, a robust connection is provided between the circular plug connector 102 and the circular mating connector 104. The robust connection is capable of withstanding harsh environments, such as vibration and shock. The connection between the plug shell 120 and the outer housing 110, such as via the outer coupling ring 130, withstands the forces exerted by the harsh environment, such that the interface between the connectors 102, 104 is maintained, generally without any stress at the interface. In various embodiments, the circular plug connector 102 may include a compression element between the outer coupling ring 130 and the plug shell 120 that allows relative movement therebetween to withstand the stresses due to vibration and shock.

Figure 2:
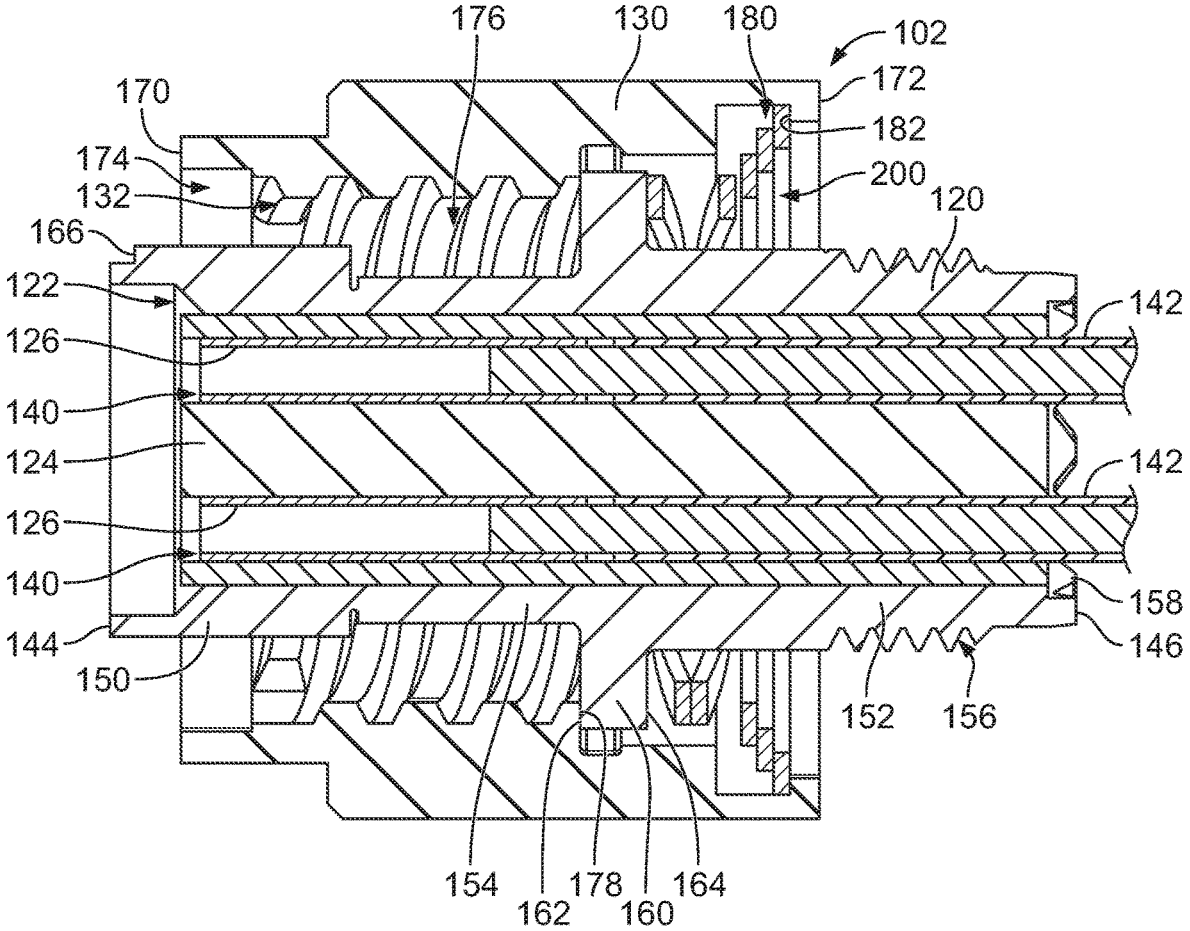
FIG. 2 is a cross-sectional view of the circular plug connector in accordance with an exemplary embodiment.

FIG. 2 is a cross-sectional view of the circular plug connector 102 in accordance with an exemplary embodiment. FIG. 2 illustrates the plug insert 124 received in the cavity 122 of the plug shell 120. FIG. 2 illustrates the plug contacts 126 held in contact channels 140 of the plug insert 124. Cables 142 are terminated to ends of the plug contacts 126 and extend rearward from the plug insert 124. FIG. 2 shows the outer coupling ring 130 coupled to the plug shell 120.

The plug shell 120 extends between a front 144 and a rear 146. The plug shell 120 includes a front body 150 at the front 144, a rear body 152 at the rear 146 and a mid-body 154 between the front body 150 and the rear body 152. In an exemplary embodiment, the plug shell 120 is a unitary structure with the front body 150, the rear body 152, and the mid body 154 being integral with each other as part of a monolithic structure. The plug shell 120 is generally cylindrical along an axial length of the plug shell 120. In various embodiments, the plug shell 120 is machined to form the various features along the exterior of the plug shell 120 and to form the cavity 122. In other various embodiments, the plug shell 120 is die-cast. The cavity 122 is open at the front 144 to expose the plug contacts 126 for mating with the mating contacts 116 (shown in FIG. 1). The cavity 122 is open at the rear 146 to allow the cables 142 to exit the plug shell 120.

In an exemplary embodiment, the rear body 152 includes threads 156, such as for attachment of a cable ferrule or other connector to the rear body 152 of the plug shell 120. Optionally, the rear body 152 may include serrations 158 at the rear 146, such as for attachment to a cable jacket, a cable ferrule or other component. In an exemplary embodiment, the mid body 154 includes a flange 160 extending therefrom. The flange 160 includes a front facing the support surface 162 and a rear facing support surface 164. The flange 160 has a larger diameter than the rear body 152 rearward of the flange 160 and the front body 150 forward of the flange 160. In an exemplary embodiment, the front body 150 includes one or more keying features 166 extending along the exterior surface of the plug shell 120 configured to interact with the circular mating connector 104 for keyed mating with the circular mating connector 104.

The outer coupling ring 130 extends between a front 170 and a rear 172. The outer coupling ring 130 includes a cavity 174 that receives the plug shell 120. The mating element 132 is provided on the interior surface of the outer coupling ring 130 defining the cavity 174. The mating element 132 is located proximate to the front 170. A space 176 is defined in the cavity 174 between the inner surface of the outer coupling ring 130 and the outer surface of the plug shell 120. The space 176 receives the outer housing 110 (shown in FIG. 1) of the circular mating connector 104.

In an exemplary embodiment, the outer coupling ring 130 includes a locating shoulder 178 within the cavity 174. The locating shoulder 178 is used for locating the plug shell 120 within the cavity 174. In the illustrated embodiment, the locating shoulder 178 is rearward facing. The front facing support surface 162 of the flange 160 is configured to be positioned against the locating shoulder 178 to axially position the plug shell 120 within the cavity 174. In an exemplary embodiment, a self-supporting compression element 200 is used to forward bias the plug shell 120 against the locating shoulder 178. The self-supporting compression element 200 is located rearward of the flange 160 and engages the rear facing support surface 164 to push the plug shell 120 in a forward direction against the locating shoulder 178. The self-supporting compression element 200 is self-supporting within the outer coupling ring 130 without the need for separate or discrete retention components to retain the self-supporting compression element 200 in the outer coupling ring 130.

In an exemplary embodiment, the outer coupling ring 130 includes a retaining element 180 formed in the inner surface of the outer coupling ring 130. The retaining element 180 may be a groove in various embodiments. The retaining element 180 may be a shoulder, a tab or other type of retaining element in other various embodiments. In an exemplary embodiment, the retaining element 180 extends entirely circumferentially around the outer coupling ring 130. The self-supporting compression element 200 is received in and retained by the retaining element 180. The retaining element 180 includes a rear lip 182 that defines a bearing surface for the self-supporting compression element 200. The self-supporting compression element 200 bears against the rear lip 182 and springs forward there from against the rear facing support surface 164 of the flange 160. In an exemplary embodiment, the outer coupling ring 130 is rotatable relative to the self-supporting compression element 200 and the plug shell 120, such as for threadably coupling to the circular mating connector 104. In an exemplary embodiment, the self-supporting compression element 200 is compressible between the flange 160 and the rear lip 182. For example, the self-supporting compression element 200 may be compressed as the outer coupling ring 130 is threaded or tightened onto the circular mating connector 104 and/or the plug shell 120 may be pressed rearward, such as during mating and/or vibration, to force the flange 160 rearward from the locating shoulder 168, which compresses the self-supporting compression element 200.

Figure 3:
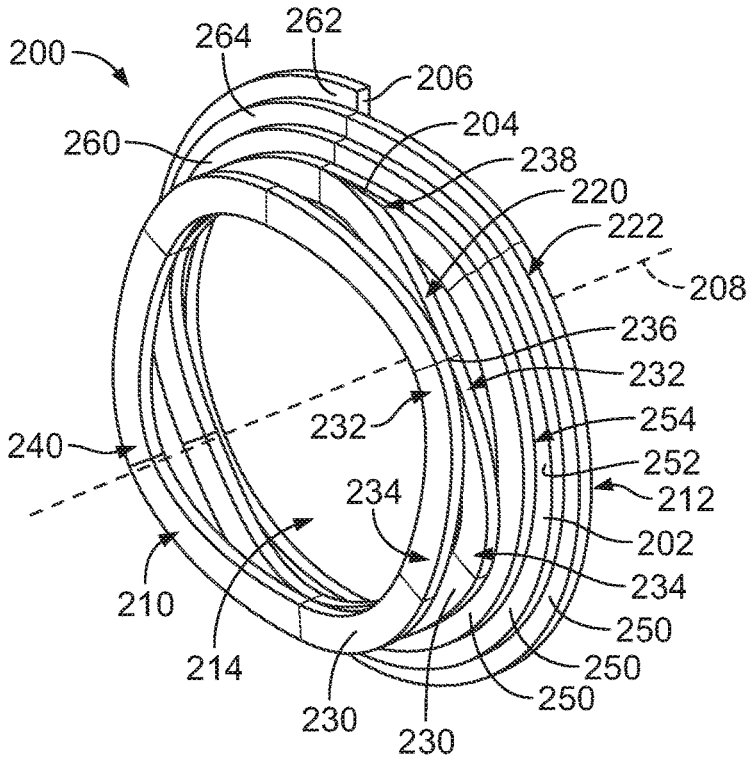
FIG. 3 is a front perspective view of a self-supporting compression element of the circular plug connector in accordance with an exemplary embodiment.

FIG. 3 is a front perspective view of the self-supporting compression element 200 in accordance with an exemplary embodiment. The self-supporting compression element 200 is a single piece structure having a continuous coil body 202 extending continuously between a first end 204 and a second end 206. For example, the coil body 202 may be extruded or cut from a single piece of metal material. The coil body 202 may be produced by a winding process or edge winding process. The self-supporting compression element 200 extends axially along a central axis 208 between a front 210 and a rear 212. The self-supporting compression element 200 is compressible along the central axis 208. The self-supporting compression element 200 includes an opening 214 along the central axis 208. In an exemplary embodiment, the self-supporting compression element 200 is circular. The self-supporting compression element 200 is spiral shaped. For example, the continuous coil body 202 includes a plurality of loops wrapped around the central axis 208.

In an exemplary embodiment, the self-supporting compression element 200 includes a spring element 220 at the front 210 and a retaining shim support 222 at the rear 212. The spring element 220 is integral with the retaining shim support 222 to form the unitary, monolithic coil body 202. In an exemplary embodiment, the spring element 220 is compressible against the retaining shim support 222. The retaining shim support 222 forms a backing layer for the spring element 220.

The spring element 220 includes a plurality of spring loops 230 being compressible to form the spring element 220. In an exemplary embodiment, the spring element 220 is a wave spring having the spring loops 230 arranged in wave patterns. For example, each spring loop 230 has undulating segments (for example, peaks and valleys). Adjacent spring loops 230 have converging sections 232 and diverging sections 234. The converging sections 232 converge toward each other and engage each other at support points 236. The diverging sections 232 diverge away from each other. Forward spring loops 230 are supported by rearward spring loops 230. Other types of spring elements 220 may be provided in alternative embodiments, such as a coil spring, a leaf spring, and the like. The spring loops 230 may be compressed rearward toward the retaining shim support 222. The rearward-most spring loop 230 is directly supported by (for example, bears against) the retaining shim support 222. For example, the spring element 220 includes a rear mating interface 240 that interfaces with the retaining shim support 222. The rear mating interface 240 may be defined by discrete, spaced apart support points where the wave shaped rear spring loop engages the retaining shim support 222. The spring element 220 includes a front mating interface 242 at the front 210 configured to engage the plug shell 120 (shown in FIG. 2). The front mating interface 242 may be defined by discrete, spaced apart support points where the wave shaped front spring loop engages the plug shell 120.

The retaining shim support 222 is spiral shaped and includes a plurality of spiral loops 250 rearward of the spring element 220. The spiral loops 250 support each other from the rear 212 toward the front 210. For example, each spiral loop 250 includes a forward-facing bearing surface 252 that supports the spiral loop 250 forward of the corresponding spiral loop 250. Each spiral loop 250 includes an overlapping segment 254 that engages the forward-facing bearing surface 252 of the spiral loop 250 behind the corresponding spiral loop 250. In an exemplary embodiment, the retaining shim support 222 is a conical helix having spiral loops 250 of different diameters, such as successively larger diameters from front to rear. The retaining shim support 222 includes an inner loop 260 and an outer loop 262. The bearing surface 252 of the inner loop 260 supports the spring element 220. The outer loop 262 has a larger diameter than the inner loop 260. One or more intermediary loops 264 may be provided between the inner loop 260 and the outer loop 262. In an exemplary embodiment, the outer loop 262 is configured to engage the retaining element 180 of the outer coupling ring 130 (both shown in FIG. 2) to position the self-supporting compression element 200 relative to the outer coupling ring 130. In an exemplary embodiment, the retaining shim support 222 of the self-supporting compression element 200 is radially compressible during assembly in an inward direction (for example, to reduce the diameter of the retaining shim support 222) to fit in the outer coupling ring 130 during assembly. The retaining shim support 222 is radially expanded (for example, to increase and expand the diameter of the retaining shim support 222) to engage the retaining element 180 and hold the self-supporting compression element 200 in the outer coupling ring 130.

Figure 4:
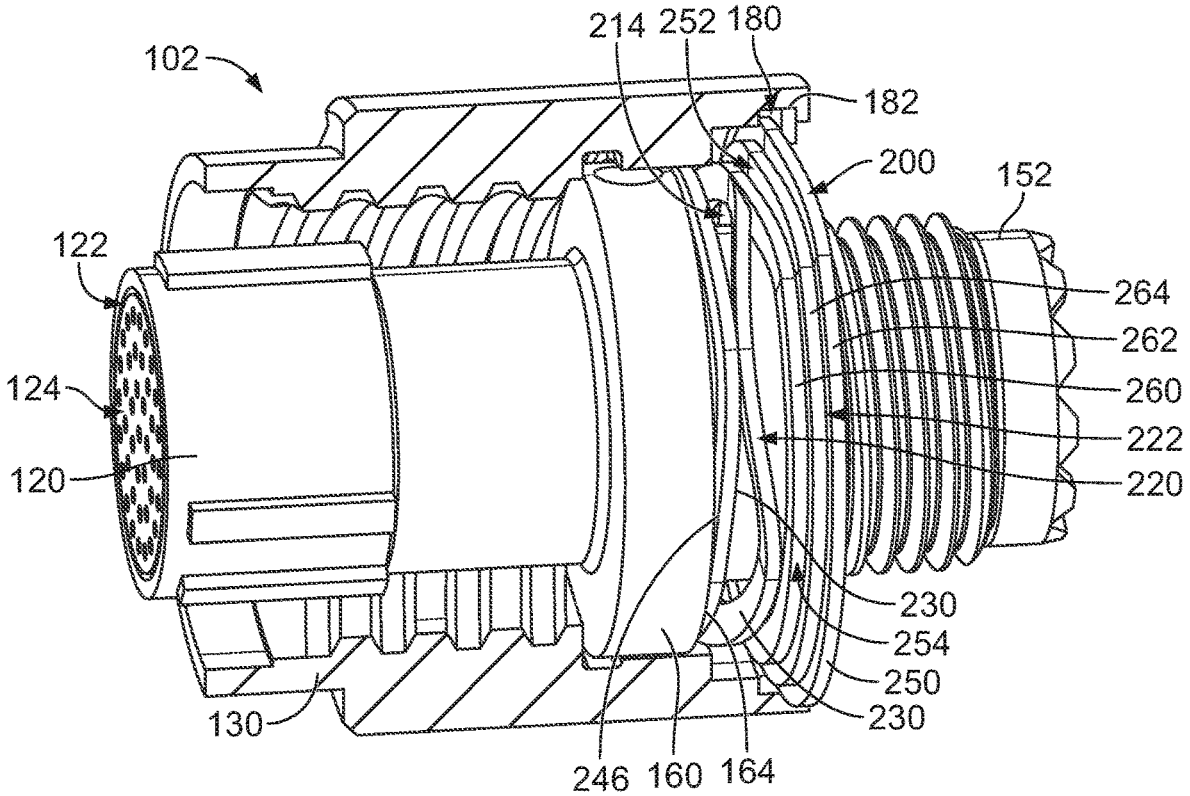
FIG. 4 is a front perspective, partial sectional view of the circular plug connector in accordance with an exemplary embodiment.

FIG. 4 is a front perspective, partial sectional view of the circular plug connector 102 in accordance with an exemplary embodiment. FIG. 4 illustrates the plug insert 124 received in the cavity 122 of the plug shell 120. FIG. 4 illustrates the self-supporting compression element 200 coupled to the outer coupling ring 130 and the plug shell 120.

When assembled, the rear body 152 of the plug shell 120 is received in the opening 214 of the self-supporting compression element 200. The spring element 220 engages the flange 160. For example, the front mating interface 242 of the front spring loop 230 engages the rear facing support surface 164 of the flange 160. The spring element 220 forward biases the plug shell 120 relative to the outer coupling ring 130. The retaining shim support 222 is received in the retaining element 180 to fix the position of the retaining shim support 222 relative to the outer coupling ring 130. The outer loop 262, having the largest diameter, is received in the retaining element 180 and abuts against the rear lip 182. The intermediate loops 264 and the inner loop 260 are supported by the outer loop 262. The overlapping segments 254 of the spiral loops 250 engage the bearing surfaces 252 of the immediately rearward spiral loop 250 to rigidly position the spiral loops 250 relative to the outer coupling ring 130.

In an exemplary embodiment, the retaining shim support 222 has a non-compressible thickness along the central axis 208. For example, each of the spiral loops 250 abut against each other to form the retaining shim support 222 used to shim and support the spring element 220. The retaining shim support 222 provides a bearing surface for the spring element 220. The spring element 220 extends forward of the retaining shim support 222 and has a compressible thickness along the central axis 208. For example, the spring loops 230 may be compressed during mating with the circular mating connector 104 and/or during shock or vibration when the circular plug connector 102 is in use.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A circular plug connector comprising:

an outer coupling ring having a cavity extending between a front and a rear, the outer coupling ring including a retaining element proximate to the rear, the outer coupling ring including a mating element proximate to the front configured to be coupled to a mating connector;

a plug shell extending between a front and a rear, the plug shell housing one or more plug contacts configured to be coupled to the mating connector, the plug shell having a front body at the front configured to be coupled to the mating connector, the plug shell having a rear body at the rear, the plug shell including a mid-body between the front body and the rear body having a rear facing support surface; and a self-supporting compression element surrounding the rear body, the self-supporting compression element extending between a front and a rear, the self-supporting compression element including a spring element at the front, the self-supporting compression element including a retaining shim support at the rear, the retaining shim support being integral with the spring element as a unitary, monolithic body, the retaining shim support being received in the retaining element to fix the self-supporting compression element relative to the outer coupling ring, the spring element engaging the rear facing support surface to support the plug shell within the cavity of the outer coupling ring, the spring element being compressible relative to the retaining shim support to allow the plug shell to move axially within the cavity of the outer coupling ring.

2. The circular plug connector of claim 1, wherein the self-supporting compression element includes an outer edge received in the retaining element.

3. The circular plug connector of claim 1, wherein the self-supporting compression element includes a continuous coil body defining the spring element and the retaining shim support.

4. The circular plug connector of claim 1, wherein the self-supporting compression element is radially compressible during assembly to fit in the outer coupling ring during assembly and radially expanded to engage the retaining element and hold the self-supporting compression element in the outer coupling ring.

5. The circular plug connector of claim 1, wherein the retaining shim support includes a bearing surface supporting the spring element.

6. The circular plug connector of claim 1, wherein the retaining shim support is a conical helix having an inner loop and an outer loop, the inner loop including a bearing surface supporting the spring element, the outer loop being received in the retaining element.

7. The circular plug connector of claim 1, wherein the retaining shim support is spiral shaped having a plurality of spiral loops rearward of the spring element.

8. The circular plug connector of claim 7, wherein the spiral loops have successively larger diameters, the spiral loops having overlapping segments defining bearing surfaces.

9. The circular plug connector of claim 1, wherein the spring element includes a front mating interface and a rear mating interface, the front mating interface facing the rear facing support surface, the rear mating interface facing the retaining shim support.

10. The circular plug connector of claim 1, wherein the spring element has a compressible thickness and wherein the retaining shim support has a non-compressible thickness.

11. The circular plug connector of claim 1, wherein the self-supporting compression element has a variable diameter along an axial length of the self-supporting compression element.

12. A circular plug connector comprising:

an outer coupling ring having a cavity extending between a front and a rear, the outer coupling ring including a retaining element proximate to the rear, the outer coupling ring including a mating element proximate to the front configured to be coupled to a mating connector;

a plug shell extending between a front and a rear, the plug shell housing one or more plug contacts configured to be coupled to the mating connector, the plug shell having a front body at the front configured to be coupled to the mating connector, the plug shell having a rear body at the rear, the plug shell including a mid-body between the front body and the rear body having a rear facing support surface; and a self-supporting compression element surrounding the rear body, the self-supporting compression element being received in the retaining element to fix the self-supporting compression element relative to the outer coupling ring, the self-supporting compression element engaging the rear facing support surface to support the plug shell within the cavity of the outer coupling ring, the self-supporting compression element being compressible to allow the plug shell to move axially within the cavity of the outer coupling ring.

13. The circular plug connector of claim 12, wherein the self-supporting compression element is a single piece structure having a continuous coil body.

14. The circular plug connector of claim 12, wherein the self-supporting compression element includes an outer edge received in the retaining element.

15. The circular plug connector of claim 12, wherein the self-supporting compression element includes a spring element and a retaining shim support rearward of the spring element, the retaining shim support being integral with the spring element as a unitary, monolithic body, the retaining shim support being received in the retaining element, the spring element engaging the rear facing support surface.

16. The circular plug connector of claim 15, wherein the self-supporting compression element includes a continuous coil body defining the spring element and the retaining shim support.

17. The circular plug connector of claim 15, wherein the retaining shim support is a conical helix having an inner loop and an outer loop, the inner loop including a bearing surface supporting the spring element, the outer loop being received in the retaining element.

18. The circular plug connector of claim 15, wherein the retaining shim support is spiral shaped having a plurality of spiral loops rearward of the spring element.

19. The circular plug connector of claim 15, wherein the spring element includes a front mating interface and a rear mating interface, the front mating interface facing the rear facing support surface, the rear mating interface facing the retaining shim support.

20. A connector system comprising:

a circular plug connector and a circular mating connector coupled together;

the circular mating connector including an outer housing having a mating end and an inner housing received in the outer housing, the inner housing holding mating contacts;

the circular plug connector comprising an outer coupling ring having a cavity extending between a front and a rear, the outer coupling ring including a retaining element proximate to the rear, the outer coupling ring including a mating element proximate to the front coupled to the mating end of the circular mating connector;

the circular plug connector comprising a plug shell extending between a front and a rear, the plug shell housing plug contacts coupled to corresponding mating contacts of the mating connector, the plug shell having a front body at the front coupled to the outer housing of the mating connector, the plug shell having a rear body at the rear, the plug shell including a mid-body between the front body and the rear body having a rear facing support surface;

the circular plug connector comprising a self-supporting compression element surrounding the rear body, the self-supporting compression element extending between a front and a rear, the self-supporting compression element including a spring element at the front, the self-supporting compression element including a retaining shim support at the rear, the retaining shim support being integral with the spring element as a unitary, monolithic body, the retaining shim support being received in the retaining element to fix the self-supporting compression element relative to the outer coupling ring, the spring element engaging the rear facing support surface to support the plug shell within the cavity of the outer coupling ring, the spring element being compressible relative to the retaining shim support to allow the plug shell to move axially within the cavity of the outer coupling ring.

* * * * *